US012655513B2

(12) United States Patent
Ruminski et al.

(10) Patent No.: US 12,655,513 B2
(45) Date of Patent: Jun. 16, 2026

(54) DEPOSITION OF COATINGS ON MANUFACTURED PRODUCTS USING REAL-TIME POWDER FEED RATE CONTROL

(71) Applicant: Kennametal Inc., Latrobe, PA (US)

(72) Inventors: Andrew M. Ruminski, Natrona Heights, PA (US); Ted Niespodziany, South Bend, IN (US); Robert J. Vasinko, Latrobe, PA (US); Qingjun Zheng, Export, PA (US)

(73) Assignee: KENNAMETAL INC., Latrobe, PA (US)

( * ) Notice: Subject to any disclaimer, the term of this patent is extended or adjusted under 35 U.S.C. 154(b) by 469 days.

(21) Appl. No.: 18/369,035

(22) Filed: Sep. 15, 2023

(65) Prior Publication Data

US 2025/0092501 A1 Mar. 20, 2025

(51) Int. Cl.
*C23C 4/129* (2016.01)
*C23C 4/08* (2016.01)
*C23C 4/10* (2016.01)

(52) U.S. Cl.
CPC ..... *C23C 4/129* (2016.01); *C23C 4/08* (2013.01); *C23C 4/10* (2013.01)

(58) Field of Classification Search
CPC ..... C23C 4/129; B05B 7/1486; B05B 5/00; B05B 7/1463; B05B 7/206
USPC ..... 427/446; 118/696
See application file for complete search history.

(56) References Cited

U.S. PATENT DOCUMENTS

| | | | |
|---|---|---|---|
| 2,900,138 | A | 8/1959 | Strate |
| 3,096,199 | A | 7/1963 | Lamb |
| 3,995,811 | A | 12/1976 | Broderick et al. |
| 4,519,541 | A | 5/1985 | Rotolico |

(Continued)

FOREIGN PATENT DOCUMENTS

| | | | |
|---|---|---|---|
| CA | 1081939 | A | 7/1980 |
| CN | 105171214 | A | 12/2015 |

(Continued)

OTHER PUBLICATIONS

Sep. 30, 2024 Non-Final Office Action U.S. Appl. No. 18/158,243, 07 Pages.

(Continued)

*Primary Examiner* — Nahida Sultana
(74) *Attorney, Agent, or Firm* — Christopher J. Owens

(57) ABSTRACT

A powder feeder system includes multiple electro-mechanical powder feeders structured for conveying powder compositions to a mixing hopper. A programmable logic control (PLC) can be incorporated into the multiple feeder system. The PLC can be programmed for determining a real-time powder flow rates for the powder feeders, receiving recipe data input related to creating a resultant coating composition, comparing powder composition flow rate data to the recipe data, and adjusting the operational aspects of motors and metering wheels associated with the multiple powder feeders in response to comparing the powder composition flow rate data to the recipe data. In various applications, the powder feeder system can be a subsystem of a thermal spray system configured for hardfacing and coating work pieces such as drill bits, road mills, shafts, mining tools, and/or stabilizers.

21 Claims, 5 Drawing Sheets

(56) References Cited

U.S. PATENT DOCUMENTS

| | | | | |
|---|---|---|---|---|
| 4,576,526 | A | 3/1986 | Muller et al. | |
| 4,614,300 | A * | 9/1986 | Falcoff | B05B 13/02 239/69 |
| 4,801,210 | A | 1/1989 | Gian | |
| 5,429,682 | A * | 7/1995 | Harlow, Jr. | G05B 19/4182 118/712 |
| 5,544,811 | A | 8/1996 | Tillery et al. | |
| 2005/0133974 | A1* | 6/2005 | Celikkaya | C04B 35/10 266/216 |
| 2008/0060574 | A1* | 3/2008 | Bacchus | C23C 4/129 118/312 |
| 2010/0151124 | A1 | 6/2010 | Xue et al. | |
| 2015/0182989 | A1* | 7/2015 | Galbraith | B05D 1/08 427/447 |
| 2015/0255778 | A1 | 9/2015 | Orisaka et al. | |
| 2020/0023390 | A1* | 1/2020 | Watkins | B05B 7/1404 |

FOREIGN PATENT DOCUMENTS

| | | | |
|---|---|---|---|
| CN | 106637044 | A | 5/2017 |
| CN | 108746959 | A | 11/2018 |
| CN | 110977122 | A | 4/2020 |
| CN | 113814543 | A | 12/2021 |
| CN | 216682829 | U | 6/2022 |
| EP | 0253177 | A2 | 1/1988 |
| GB | 958510 | A | 5/1964 |

OTHER PUBLICATIONS

Oct. 11, 2025 Foreign Office Action Chinese Application No. CN202410057842.4, 2 Pages.

"Plasma Transferred Arc (PTA)," Starweld™, 16 Pages.

Kennametal Inc., Kennametal Stellite KK2 Powder Feeder Operations & Maintenance with Parts List, Rev. C, 05, 2020.

Kennametal, Inc., Wear Solution Technology Bulletin: NiCAR Hardfacing Rods, 2021.

Liu W., et al., "Microstructure and Wear of Ni-WC Hardfacing Used for Steel-Body PDC Bits," International Journal of Refractory Metals and Hard Materials, 2021, vol. 101, pp. 1-11, Retrieved from the Internet: URL: https://doi.org/10.1016/j.ijrmhm.2021.105683.

Jan. 29, 2025 Notice of Allowance for U.S. Appl. No. 18/158,243, 08 Pages.

* cited by examiner

DEPOSITION OF COATINGS ON MANUFACTURED PRODUCTS USING REAL-TIME POWDER FEED RATE CONTROL

FIELD OF THE INVENTION

The present disclosure generally relates to tools and techniques associated with multi-component electro-mechanical powder feeder systems used for depositing coatings on articles of manufacture. These systems may be used to coat various types of manufactured products such as drill bits, road mills, shafts, mining tools, and/or stabilizers, for example.

BACKGROUND

Deposition of coatings on manufactured products can be accomplished by various techniques, including flame spray technology, plasma transferred arc (PTA), cold spray technology, and/or other combustion based or non-combustion based techniques. For example, despite its maturity, flame spraying is still a salient technology particularly in wear coating applications. The continued relevance of flame spraying is due in large part to the versatility and simplicity of the technique. This technique continues to have beneficial applications in petroleum well drilling applications, for example.

Among other kinds of industrial tools, steel body drills used in the petroleum industry, for example, have complex geometries and require composite wear coatings containing mixtures of materials that often have disparities in density and particle size between or among the material's composition constituents. Accordingly, powders for thermal spray processes, such as plasma transferred arc (PTA) and flame spray, are usually dispensed by using meters to set velocities calibrated to deliver powders at known flow rates. However, if multiple powder components are dispensed with multiple feeders, there is currently no process available to provide real time data and feedback to control different powder feed rates associated with different powder feeder apparatus. Among other benefits, graded coatings with a continuous spectrum of chemical and/or physical properties may be created using a spray system which can effectively leverage multiple electromechanical feeders.

Accordingly, enhanced tools and techniques are needed for thermal spray systems equipped with a multi-feeder subsystem for controlling the flow rates and composition of resultant coatings more precisely and automatically, and without requiring excessive calibration or other manual operator intervention.

SUMMARY

According to the present disclosure, a powder feeder system comprises: a first electro-mechanical powder feeder structured for conveying a first powder composition to a mixing hopper, the first powder feeder having a first metering wheel operatively associated with a first motor; a second electro-mechanical powder feeder structured for conveying a second powder composition to the mixing hopper, the second powder feeder having a second metering wheel operatively associated with a second motor; and a programmable logic control (PLC). The PLC can be programmed for determining a real-time powder flow rate associated with a flow rate of the first powder composition from the first powder feeder, determining a real-time powder flow rate associated with a flow rate of the second powder composition from the second powder feeder, receiving recipe data input related to at least one resultant coating composition, comparing at least one of the determined first powder composition flow rate and/or the determined second powder composition flow rate to at least a portion of the received recipe data, and adjusting at least one operational aspect of at least one of the first motor and/or the second motor in response to comparing at least one of the received first powder composition flow rate data and/or the received second powder composition flow rate data to at least a portion of the received recipe data.

The powder feeder system may further comprise a load cell operatively associated with at least one of the first powder feeder and/or the second powder feeder. The PLC can be further programmed for determining at least one of the powder composition flow rates in response to data communicated to the PLC from the load cell. The recipe data may comprise one or more sets of ratios including at least one tolerance range associated with the resultant coating composition.

In certain embodiments, the PLC can be programmed for calculating a ratio between the determined first powder composition flow rate and the determined second powder composition flow rate, comparing the calculated powder flow rate ratio to at least one ratio contained in the recipe data, and adjusting at least one operational aspect of at least one of the first motor and/or the second motor in response to comparing the calculated powder flow rate ratio to at least one ratio contained in the recipe data.

In other embodiments, the PLC can be programmed for receiving a total mass flow setting value from a control device, calculating a ratio between the determined first powder composition flow rate and the determined second powder composition flow rate, and comparing the calculated flow rate ratio to the total mass flow setting value obtained from the control device. The PLC can be further programmed for adjusting at least one operational aspect of at least one of the first motor and/or the second motor in response to comparing the calculated flow rate ratio to the total mass flow setting value obtained from the control device. Adjusting at least one operational aspect of at least one of the first motor and/or the second motor may comprise automatically communicating a signal to at least one of the motors to increase or decrease at least one motor rotational velocity.

In certain embodiments, the PLC can be programmed for receiving at least one carrier gas flow rate associated with a carrier gas source, comparing the received carrier gas flow rate to gas flow data contained in the recipe data, and determining whether the received carrier gas flow rate is outside of a predetermined range for the recipe gas flow data. The PLC can be programmed for receiving the carrier gas flow rate data from at least one mass flow controller, and/or programmed for communicating a signal to at least one flow adjustment valve associated with at least one of the carrier gas sources. The signal can include a command for increasing or decreasing carrier gas flow in response to the determination of whether the received carrier gas flow rate is outside of a predetermined range for the recipe gas flow data.

The powder feeder system can include a control device structured for manipulation by an operator. The control device can be structured to allow the operator to vary a volume of a total powder feed of the feeder system.

The powder feeder system may further comprise a powder nozzle in communication with the mixing hopper, wherein the powder nozzle has an orifice. A thermal spray subsystem can be structured with a torch or spray nozzle having an orifice; and the powder nozzle orifice and the torch or spray nozzle orifice can be in juxtaposition relative to each other.

The first powder feeder may contain powder comparatively larger in size than a powder contained in the second powder feeder. Also, the first powder feeder may contain powder comparatively denser than a powder contained in the second powder feeder. In certain embodiments, the first powder feeder may include a hopper containing a powder comprising tungsten carbide; and the second powder feeder can include a hopper containing a powder comprising a nickel-based alloy or a cobalt based alloy.

The resultant coating composition may comprise a hardfacing coating composition which can be suitable for application to a work piece. The work piece can comprise at least one of a drill bit, a road mill, a shaft, a mining tool, and/or a stabilizer.

These and other embodiments of this invention shall be described in more detail and in the drawings that show certain embodiments of this invention.

BRIEF DESCRIPTION OF THE DRAWINGS

While various embodiments of this invention are illustrated in the drawings, the particular embodiments shown should not be construed to limit the claims recited herein. Various modifications and changes may be made without departing from the scope of the claimed invention.

DETAILED DESCRIPTION

The present disclosure provides tools and techniques to control coating systems, comprising a multi-component thermal spray subsystem and a powder feeder subsystem, using a programmable logic control (PLC), for example. In various embodiments, these processes can use real time powder flow data and/or mass flow data to create a highly consistent multi-component coating with PTA, flame spray, cold spray, and/or other suitable spray techniques. This thermal spray technology can be applied to hardfacing steel bodied drill bits, stabilizers, road mills, mining tools, and downhole petroleum applications, for example, among other kinds of work pieces, industrial tools, and other uses and applications. In certain embodiments, the PLC can be embodied as an industrial computer control system programmed to continuously monitors the state of input devices and makes decisions based upon algorithms or other programs to control the state of output devices within the system. In other embodiments, the PLC can be an engine or module comprised of a combination of hardware, software, and/or firmware for performing the tasks, services, and functions described herein.

In certain embodiments, the PLC can be programmed to receive and process continuous or substantially continuous inputs from load cells on the powder hoppers and mass flow controllers, for example, and to receive and process data received from multiple powder feeders. Among other functions, the PLC can be programmed to output commands to control power to metering devices or to communicate signals to open or close solenoid valves supplying carrier gases (e.g., nitrogen or argon at 40 psi) to a hopper of the feeder, for example. The PLC can be programmed to control dispensing of the powders based on predetermined recipes which may vary by component geometry. The PLC can be programmed to perform a process for adjusting parameters with a mass loss algorithm, for example, which can be executed by continuously or substantially continuously measuring load cell data. Also, mass flow controllers can be used in the thermal spray system which are configured to control carrier gas flow rate and to provide data signals indicative of carrier gas flows to the PLC.

Figure 1:
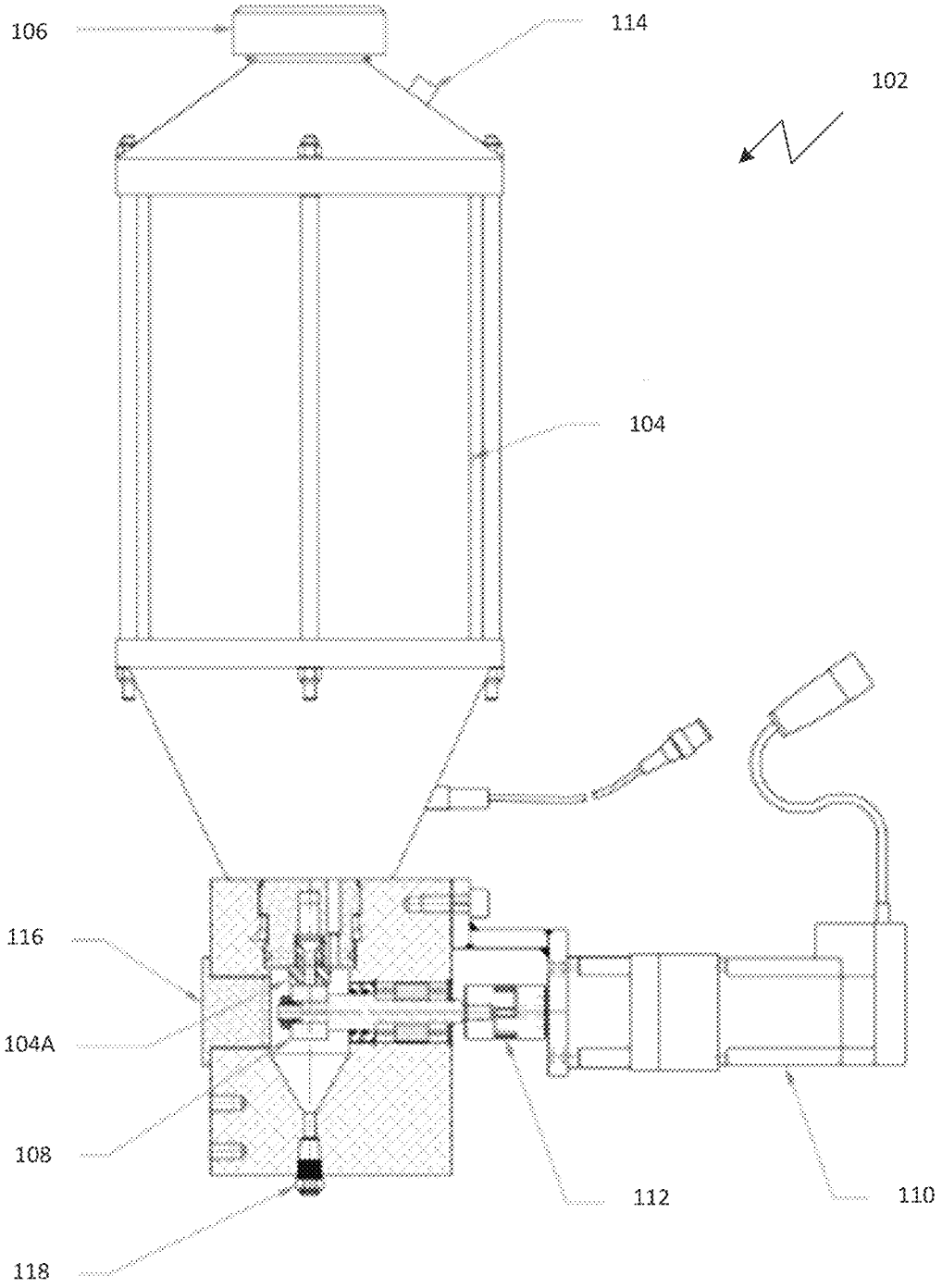
FIG. 1 schematically illustrates one example of an electro-mechanical powder feeder which can be used in connection with certain configurations of thermal spray equipment, systems, and processes.

FIG. 1 illustrates an example of one type of electro-mechanical powder feeder 102 which can be used in connection with thermal spray equipment including multiple electro-mechanical powder feeders (this equipment configuration is described in more detail in connection with the discussion of FIG. 3 below). The powder feeder 102 can be structured for feeding a composition component in the form of a powder in operative association with a combustion welding torch or plasma torch, for example, of the thermal spray equipment. In other embodiments, the torch may instead be a nozzle or another similar structure, such as a spray nozzle of a cold spray thermal spray subsystem, for example. The feeder 102 can volumetrically dispense one or more kinds of constituents of hardfacing composite materials, for example. The feeder 102 includes a hopper 104 with a removable lid 106 for purposes of loading (or unloading) the hopper 104 with desired powder material. The powders can be dispensed from the hopper 104 through an orifice 104A by the action of a rotating knurled metering wheel 108, with the aid of gravity and/or a carrier gas such as argon or nitrogen, for example. Metering devices employed by the powder feeder 102 may include rotating knurled wheels, slotted discs, and/or vibrating hoppers, among other types of metering devices. The quantity of powder dispensed through the feeder 102 can be controlled by adjusting an electrical current applied to an electric motor 110 coupled to the metering wheel 108 via coupling 112 for driving rotational velocity of the metering wheel 108. It follows that a composition of a resultant powder coating can be controlled by adjusting the rotational velocities of the metering wheels on multiple feeders. Each of the various motors described herein may be, for example but not limited to, an electric motor powered by DC or AC current, a hydroelectric powered motor, and/or a pneumatic motor.

In other aspects of the powder feeder 102, a pressure relief valve 114 can be used for controlling pressure levels of carrier gas, for example, used within the feeder 102. An insertable and removable inspecting plug 116 can be incorporated into the feeder 102 for inspecting certain internal operations of the feeder 102. A tube connector 118 can be provided for connecting an outlet tube or other structure to convey powder to interface with other components of the thermal spray system, such as a combustion torch (as described in more detail below).

Figure 2B:
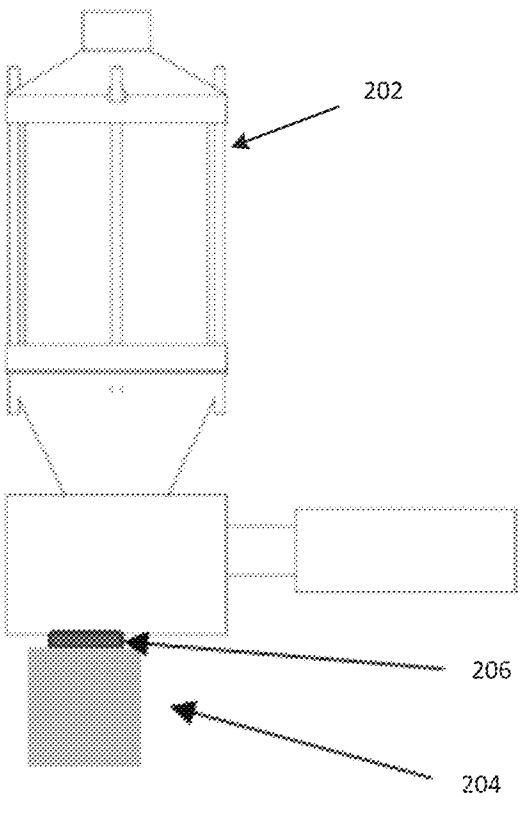
FIG. 2B shows a side view of the powder feeder of FIG. 2A.
Figure 2A:
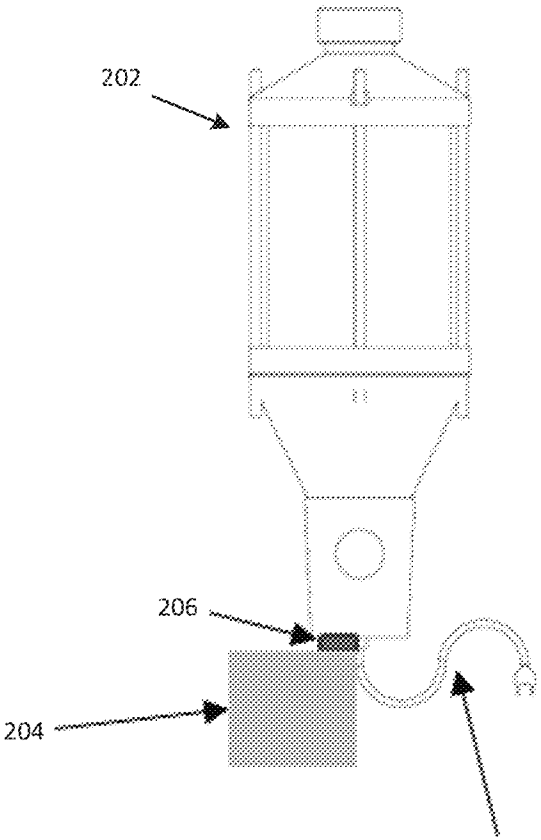
FIG. 2A schematically illustrates a front view of another example of an electro-mechanical powder feeder which can be used in connection with certain configurations of thermal spray equipment, systems, and processes.

FIG. 2A schematically illustrates a front view of another example of an electro-mechanical powder feeder 202 which can be used in connection with certain configurations of thermal spray equipment and processes. FIG. 2B shows a side view of the powder feeder 202 of FIG. 2A. In this configuration, the feeder 202 can be mounted on a structure such as a support frame 204 with a load cell 206 interposed between the feeder 202 and the support frame 204. The load cell 206 may be a high-resolution load cell, for example. The load cell 206 can be programmed to transmit data in the form of voltage signals to the PLC which are proportion to the mass of the feeder 202 containing the particular resultant composition component being processed and deposited by the feeder 202 as part of the overall thermal spray process. An outlet tube 208 can be provided to convey powder from the feeder 202 to other components or subsystems of the thermal spray system. Those skilled in the art will appreciate that comparatively larger particles (e.g., perhaps greater than 200 micrometers in diameter) of a dense material such as tungsten carbide, for example, can be dispensed from a first powder feeder. At the same time, comparatively finer particles (e.g., perhaps less than 200 micrometers in diameter) which comprise nickel or cobalt based alloy, for example, can be dispensed from a second feeder for mixing with the tungsten carbide conveyed by the first feeder. To resist segregation in hardfacing applications, for example, powder constituents of the resultant composition can be sorted by particle size in the different powder feeders.

Figure 3:
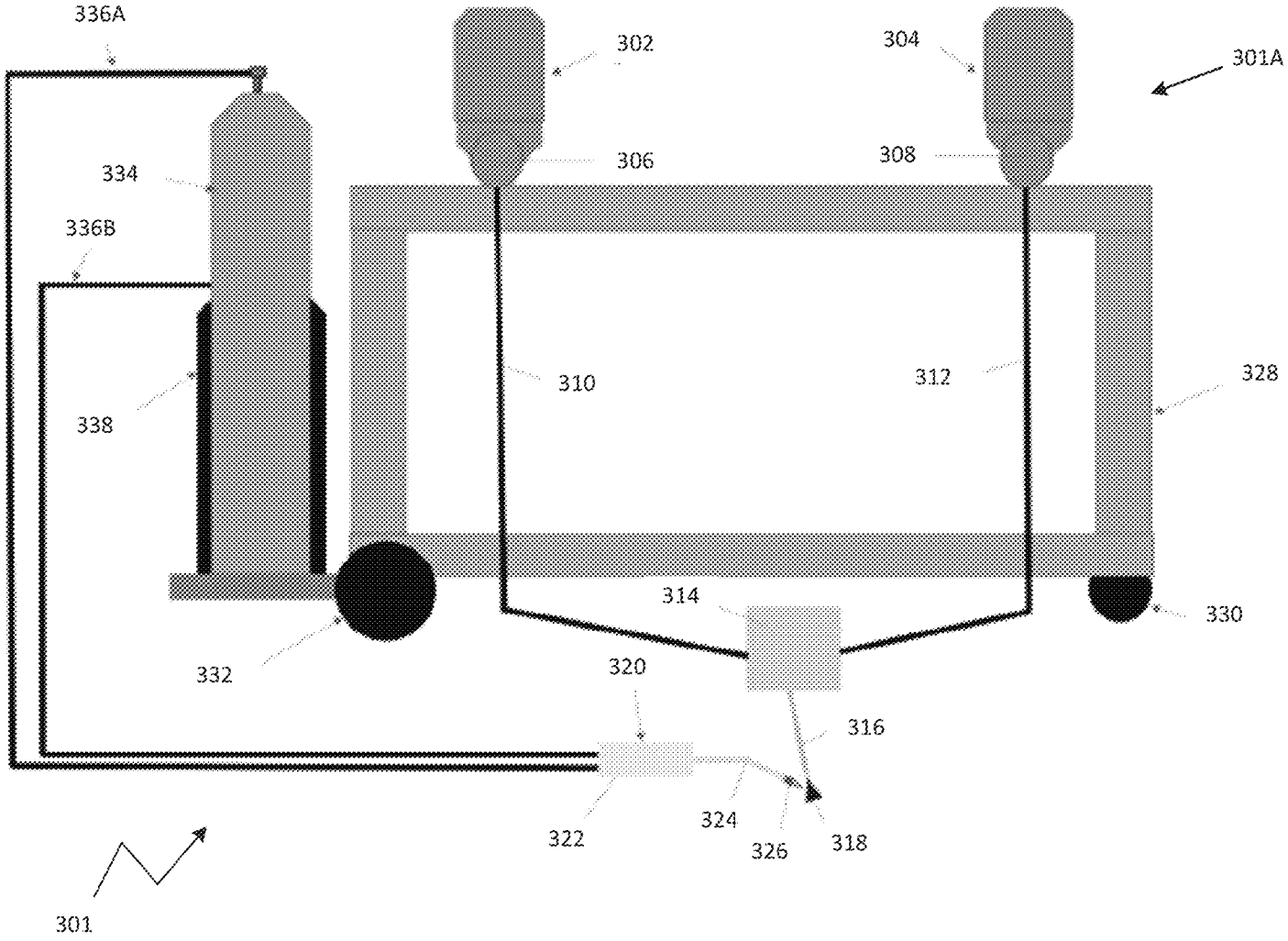
FIG. 3 schematically illustrates an example of a thermal spray system configuration including a powder feeder subsystem.

FIG. 3 illustrates a powder feeder system 301A as a subsystem of a multi-component electro-mechanical coating deposition system 301. The feeder system 301A includes a first electro-mechanical powder feeder 302 and a second electro-mechanical feeder 304, each in communication with a mixing hopper 314. In the overall system 301, the mixing hopper 314 can be in communication with a powder nozzle 316 having an orifice 318 and a combustion torch 320 having an orifice 326, wherein the orifice 318 of the powder nozzle 316 can be in juxtaposition to the orifice 326 of the combustion torch 320. A first metering wheel of the feeder 302 can be rotatably driven by a first motor 306. The first feeder 302 can be in communication with a first feeder tube 310. A second metering wheel of the second feeder 304 can be rotatably driven by a second motor 308. A second feeder tube 312 can be in communication with the second feeder 304. A mixing hopper 314 can be in communication via the tubes 310, 312, with the feeders 302, 304 (respectively). It can be appreciated that one or more additional feeders may be incorporated to function in this configuration within the scope of the invention. The combustion torch 320 can include a combustion chamber 322 and a tube port 324. The tube port 324 can be in communication with the combustion chamber 322 of the combustion torch 320, and the tube port 324 can have the orifice 326 which can be in juxtaposition to the orifice 318 of the powder nozzle 316.

The thermal spray deposition system 301 can incorporate a structure 328 (e.g., a cart) which can be readily movable from one location to another. In certain embodiments, the structure 328 can have one or more sets of wheels 330, 332 to facilitate movement of the structure 328 from location to location.

In certain applications, powders conveyed through the system 301 can be combined in the mixing hopper 314. The combustion torch 320 can produce thermal energy through the combustion of gases such as acetylene contained in a second tank 338, for example, and an oxidizer such as compressed gaseous oxygen contained in a first tank 334, for example. The first tank 334 can be in communication with a first supply line 336A that can be in turn in communication with the combustion chamber 322 of the combustion torch 320. The second tank 338 can be in communication with a second supply line 336B that in turn can be in communication with the combustion chamber 322 of the combustion torch 320. The mixing hopper 314 can vent excess carrier gas through a filtered vent which prevents the egress of hardfacing powders. The hardfacing mixed powder (e.g., the powder combined from the powder in the first feeder 302 and the powder from the second feeder 304) exits the mixing hopper 314 into the powder nozzle 316 under the influence of gravity and/or carrier gas pressure. The mixed powder in the mixing hopper 314 can be introduced to a thermal source such as a combustion flame formed by the combination of the acetylene gas from the second tank 338, for example, and oxygen from the first tank 334 in the combustion chamber 322 of the combustion torch 320, for example, exiting the orifice 326 of the combustion torch 320. The mixed powder stream and the combustion flame may interact at a substrate such as an article of manufacture or a work piece prepared for application of hardfacing or another coating. The thermal energy from the substrate (e.g., which may be preheated) and the combustion flame can melt the nickel or cobalt based alloys of the mixed powder, for example. This provides a densified matrix for wear resistant particles such as tungsten carbide.

In certain embodiments, the combined output of the first and second electro-mechanical feeders 302, 304 can be a maximum of 200 g/min (grams/minute), for example. After the alloy and carbide powders have been dispensed, the comparatively larger and comparatively finer particles can be conveyed to the mixing hopper 314 in the first feeder tube 310 and the second feeder tube 312 (which can be made of polymer tubing). In certain embodiments, the first and second feeder tubes 310, 312 have a length of from one foot to greater than 12 feet in length. The powders can be carried by a carrier gas such as argon or nitrogen, for example, through the first and second feeder tubes 310, 312, respectively. Due to the influence of the carrier gas, the powders in the feeder tubes 310, 312, can flow independently of the effects of gravity. The feeder tubes 310, 312 may be manipulated or reconfigured into a plurality of different angles and positions to facilitate optimum conveyance of powder during hardfacing or coating deposition processes. The resultant composition of the coating that can be deposited upon an article of manufacture can be controlled by independently adjusting the rotational velocity of the first and second metering wheels of the feeders 302, 304, and/or by controlling the intensity, temperature, or other characteristics of the flame feed exiting through the orifice 326 of the combustion torch 320.

Figure 4:
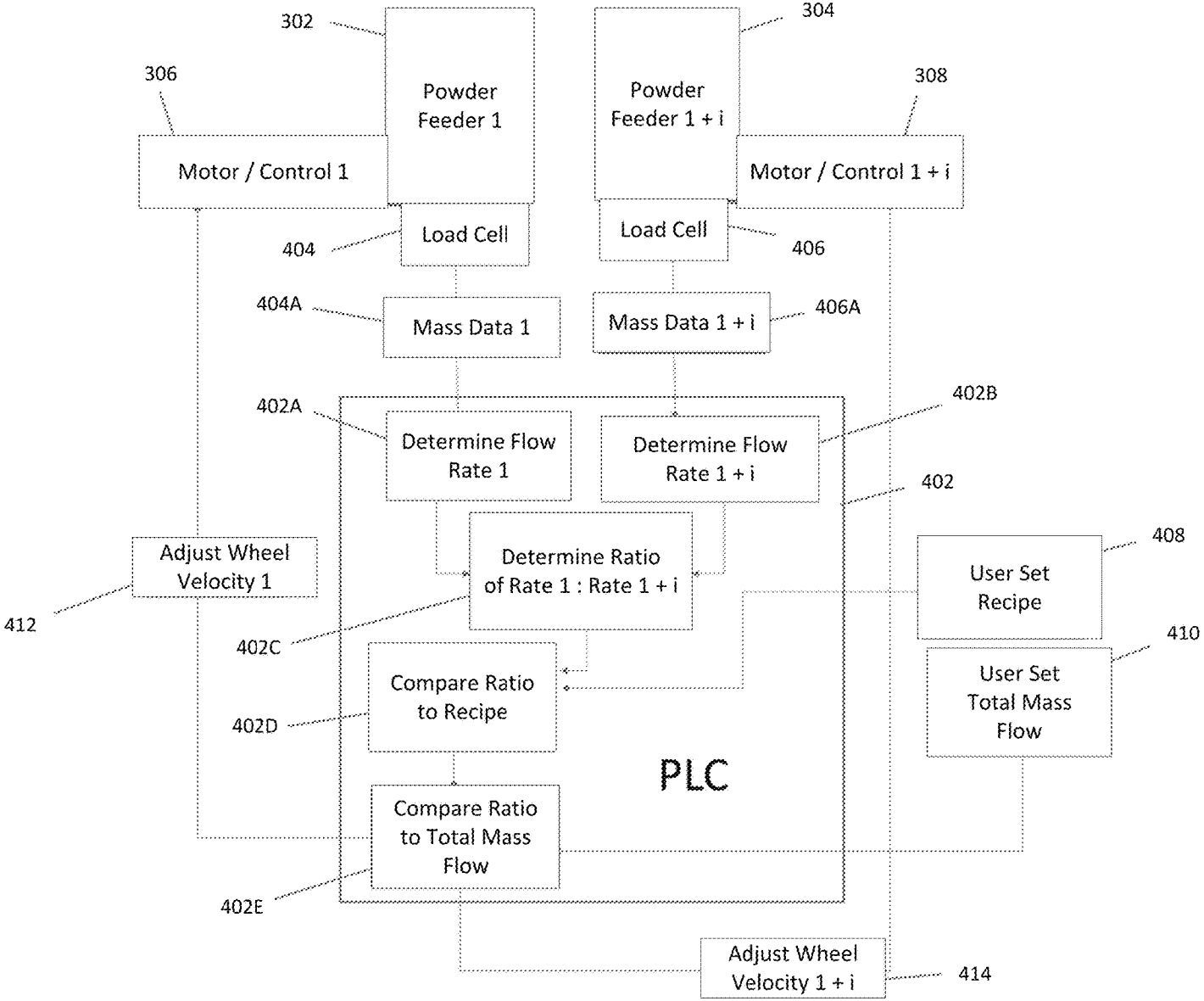
FIG. 4 shows one example of a combined process flow and computer architecture diagram illustrating various tasks and functions which can be performed by a programmable logic control (PLC).

FIG. 4 shows an example of a combined process flow and computer architecture diagram illustrating various tasks and functions performed by a programmable logic control (PLC) 402 in connection with certain embodiments of the invention. The PLC 402 may comprise hardware, circuitry, software, firmware, artificial intelligence modules, and/or other computer-based components. The PLC 402 can be configured to receive input data or input signals from various data sources. In this example, a load cell 404, 406 is operatively associated with each of the powder feeders 302, 304 (respectively). Each load cell 404, 406 can be programmed to communicate mass data 404A, 406A (respectively) in the form of voltage signals transmitted to the PLC 402. The mass data 404A, 406A can include data indicative of the mass of the feeders 302, 304 (respectively) containing powder being deposited by the thermal spray process. The PLC 402 can also receive input data in the form of different kinds of user recipe data 408 associated with the composition for the hardfacing or coating to be applied by the thermal spray system. The user recipe data 408 may comprise one or more sets of ratios (with or without tolerances) for the desired composition of the hardfacing or coating. In certain embodiments, a physical control device 410 (e.g., a knob or dial) can be provided with a display, for example, for manipulation by an operator or other user. This control device 410 can allow the operator to vary a volume of the total powder feed between approximately 10 g/min to 200 g/min, for example. It can be seen how such a feature increases the versatility of the present tools and techniques by allowing the operator to apply coatings to comparatively larger surface areas, comparatively narrower scale features, and/or to both kinds of features which may exist within the same work piece. The total powder feed setting of the device 410 can provide a limit by which an algorithm executed by the PLC 402 adjusts velocities of the motors 306, 308, for example.

As shown in FIG. 4, the PLC 402 may be programmed to perform or direct various computer-executable functions within the overall coating system, the powder feeder subsystem, and/or the thermal spray subsystem. The PLC may be programmed with a module 402A for determining a powder flow rate for the first powder feeder 302, a module 402B for determining a powder flow rate for the second powder feeder 304, and/or a module 402C for determining a ratio of the flow rates output by the modules 402A, 402B. In another aspect, another module 402D can be programmed to compare the ratio calculated by the module 402C to one or more ratios contained in the user recipe data 408. A module 402E can be programmed to compare the ratio calculated by the module 402C to a total mass flow setting value obtained from the control device 410. In response to these determinations and calculations, the PLC 402 can accordingly adjust the operation of the motor 306 at step 412 (e.g., to adjust metering wheel velocity for the feeder 302), and/or adjust the operation of the motor 308 at step 414 (e.g., to adjust metering wheel velocity for the feeder 304). It can be seen that as the mass of the feeders 302, 304 are reduced, the flow rates of the powders can be determined by an algorithm stored in the PLC 402 for processing the voltage signals. The ratio(s) of mass flow data can then be compared to the mass flow rate in the recipe data 408. If the ratio of mass flows is outside of a predetermined tolerance in the recipe data 408, for example, the algorithm can automatically communicate a signal to one or both of the motors 306, 308 (e.g., at steps 412, 414, respectively) to either increase or decrease motor rotational velocities, which in turn adjusts metering wheel rotation, and which subsequently restores the ratios of powder mass flows to a prescribed range and/or within predetermined tolerance levels.

Figure 5:
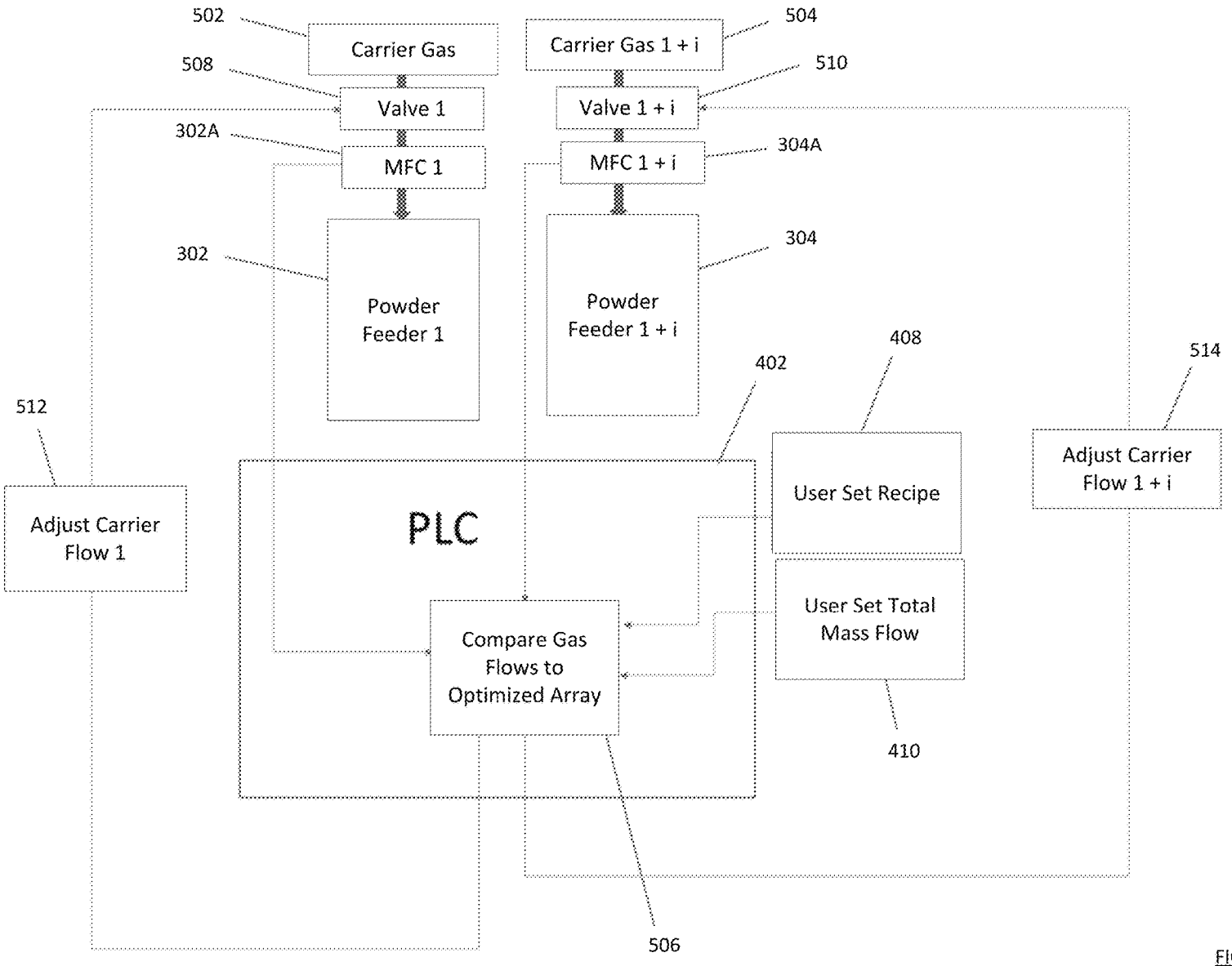
FIG. 5 shows another example of a combined process flow and computer architecture diagram illustrating various tasks and functions which can be performed by a programmable logic control (PLC).

FIG. 5 shows another example of a combined process flow and computer architecture diagram illustrating various tasks and functions performed by the programmable logic control (PLC) 402 in connection with certain embodiments of the invention. To increase the density of an applied coating and to improve the deposition efficiency of the process, use of carrier gas flowing from tanks 502, 504 can be optimized or minimized through the use of continuously or substantially continuously collected gas flow data. An algorithm 506 stored in the PLC 402 can be executed to compare the gas flow data 502A, 504A to an optimized array, for example. The carrier gas flow rates delivered to each feeder 302, 304 can be adjusted by manipulating valves 508, 510 (respectively), for example, at steps 512, 514 (respectively). The algorithm 506 can receive process data signals communicated from mass flow controllers 302A, 304A, as shown in FIG. 5. The data from the mass flow controls 302A, 304A can be compared to an array of prescribed data gas flow data by the algorithm 506, as a function of the individual powder flow rates as determined by the recipe data 408 and the total powder flow rate 410. If one or more carrier gas rates are outside of the prescribed limits or ranges as determined by the recipe 408 and the total powder flow rate 410, then one or more signals can be communicated at step 512 and/or step 514 to the flow adjustment valves 508, 510 (respectively). This can result in either increasing or decreasing the carrier gas flows as needed to optimize the coating quality and deposition efficiency.

The tools and techniques described above can be conducive to automation and can be capable of safely and effectively depositing uniform composites comprising large carbides, small carbides, and/or nickel alloy powders to various work pieces or articles of manufacture, such as steel body drill bits. The thermal spray deposition systems described herein can apply a wear coating with abrasion and erosion resistance characteristics, for example, to articles of manufacture or work pieces.

In one example, these tools and techniques can be used with flame spray to deposit coatings on steel bodied drill bits used in petroleum drilling applications. The coating may comprise a fusible nickel-based alloy containing carbon, boron, silicon, chromium, and iron simultaneously deposited with spherical cast tungsten carbide. The final coating can contain approximately 60 weight percent spherical cast tungsten carbide with a particle size distribution in the range of 125 to 210 microns. Two compositions can be simultaneously dispensed from two separate powder feeders and mixed prior to confluence with a combustion torch to resist segregation and produce a consistent, high-quality coating.

Since steel bodied drill bits may be comprised of open unobstructed areas on the blades on the order of 25 $cm^2$ and constricted areas between cutter pockets on the order of 5 $cm^2$, there can be a need to vary powder deposition parameters on a routine basis. This task may be facilitated by use of the load control system described herein, including the use of load cells 404, 406, communicating mass data 404A, 406A (respectively) to the PLC 402. By turning an external physical knob or other similar control 410, for example, an operator can rapidly and effortlessly set a new total powder flow conducive to the geometric attributes of the area or article on which a coating is being deposited. For example, if the operator needed to switch between depositing hardfacing on an unobstructed blade area at total powder flow rate of 125 g/min to a highly constricted pocket area at total powder flow rate of 25 g/min, then the operator may set a new powder flow rate of 25 g/min by turning the knob 410. An algorithm in the PLC then recognizes the new limit (at 402E) and reduces power to the metering wheels of the feeders 302, 304. This occurs until the time when load cell data 404A, 406A indicate that 15 g/min of spherical cast tungsten carbide has been dispensed simultaneously with 10 g/min of fusible nickel-based alloy.

To maintain an optimal deposition efficiency and reduce porosity, flow from the carrier gas 502, 504 can be scaled with powder flow rates. For example, a nitrogen carrier gas flow rate used to convey the spherical cast tungsten carbides may be reduced from 10 standard liters/min sustaining a powder flow of 75 g/min to 2 standard liters/min to sustain a new powder flow rate of 15 g/min. Likewise, the nitrogen carrier flow rate conveying fusible nickel-based alloy may be reduced from around 3 standard liters/min, sustaining a powder feed rate of 50 g/min to 0.6 standard liters/min, to support a new alloy powder feed rate of 10 g/min. The carrier gas feed rates can be adjusted by utilizing an algorithm in the PLC 402 to compare actual gas flow rates from the mass flow controllers 302A, 304A to an array of optimized gas flow rates (at 506). The array can be a function of the user selected total powder flow rate (e.g., using control 410) and the coating recipe 408. The logic in the algorithm sends signals to one or both of the motor operated gas flow valves 508, 510 to adjust the flow rates as needed.

It can be seen that the application of this digitally controlled process results in increased productivity in unobstructed areas, less overspray in constricted areas, increased powder deposition efficiency, better coating quality, and concurrently less time and effort on the part of the operator to manipulate the thermal spray system and the overall coating system.

Those skilled in the art can also appreciate the capability of the coating system 301 of the present invention to handle both comparatively larger particle sizes (e.g., particles greater than 200 microns in size) and comparatively smaller particles sizes (e.g., particles less than 200 microns in size). The digitally controlled processes and techniques described herein make it possible for the coating system 301 to accommodate and effectively process a wide range of different particles having disparate sizes and/or densities.

In another example, the composition and thickness of wear resistance coatings can be varied as a function of component geometry. The work piece can be a wedge-shaped, wear resistant tip on a steel bodied radial tool for use in mining operations. The coating system 301 may include a fusible nickel-based alloy containing carbon, boron, silicon, chromium, and iron simultaneously deposited with angular macrocrystalline tungsten carbide particles with a particle size distribution between 54 and 150 microns. These powders may be conveyed with the use of argon gas to a PTA torch.

Given that carbides settle in PTA deposited coatings, thicker coatings generally require higher carbide loadings to counteract the effects of settling and maintain wear resistance throughout the thickness of the coating. For example, a 0.5 mm coating with a 40 weight percent carbide loading has limited carbide settling and provides sufficient wear resistance in many applications. However, a hardfacing coating with 40 weight percent carbide experiences significant settling if the deposition layer thickness can be increased to 2.5 mm. This coating will be ineffective as a hardfacing until a significant portion, perhaps on the order of one-third of the layer, can be removed by abrasion. Therefore, a single pass 2.5 mm hardfacing layer may require a 60 weight percent carbide loading to achieve a relatively uniform abrasion resistance. In a wedge-shaped tip on a mining tool, depositing a high carbide loading near the tip, in addition to using more relatively expensive carbides, also reduces the impact resistance of the tip which can be also subjected to the greatest impact of the component. Thus, creating a graded carbide composition is a useful attribute.

The tools and techniques described herein can consistently create a hardfacing coating which changes in composition and thickness as a function of surface geometry. For example, a coating can be applied to an isosceles triangle-shaped wedge at the tip of a mining tool which can be on the order of 3 $cm^2$. The tip of this wedge may range from 0.5 mm in thickness at the leading edge to 2 mm thickness on the trailing edge. From leading edge to trailing edge, the carbide loading may be varied from 40 weight percent to 60 weight percent, thus creating a more impact resistance coating with uniform abrasion resistance.

The previously described process algorithms executed by the PLC 402 may be modified to change both the total powder feed rate and the ratio of carbide to nickel-based alloy as functions of time. For example, one or more algorithms of the PLC 402 may be used to gradually increase the total powder rate from approximately 12.5 g/min to 50 g/min over the course of a welding operating, while at the same time providing a signal to the PTA power supply to increase the current from approximately 80 A to 130 A. During this work evolution, the carbide flow rate can be increased, with a step function, from 5 g/min to 30 g/min while at the same time the alloy flow rate may be scaled to a slower rate in the range of 7 g/min to 20 g/min. The result of such a work evolution is a unique, graded wear resistance product with good impact resistance at the leading edge and uniform abrasion resistance throughout the component.

In another example, the present tools and techniques can be applied to other non-fusion, high velocity thermal spray processes such a High Velocity Oxygen Flame (HVOF) or cold spray. In such an application, the metering knurled wheels of the powder feeders 302, 304 may be replaced with a rotating slotted discs also driven by electric motors 306, 308 (respectively). The powder hoppers of the powder feeders 302, 304 in such an application can be substantially continuously monitored by the load cells 404, 406 (respectively) sending signals to the PLC 402 in tandem with the mass flow controllers 302A, 304A (respectively) measuring carrier gas 502, 504 (respectively) flow rates. The carrier gases 502, 504 may include argon and nitrogen.

The present process may be used in combination with a cold spray process which can be used to enhance the wear performance of low alloy steel shafts on road rehabilitation tools. In this instance, a graded cold spray coating may be applied with high pressure nitrogen gas (on the order of 6.5 MPa). This coating may be designed so that one end of the shaft has greater impact resistance transitioning to greater wear resistance at the opposite end of the shaft. This goal can be achieved by simultaneously applying varying ratios of cobalt-based alloys and sintered cemented tungsten carbide particles. The cobalt-based alloy may comprise alloying elements, such as chromium, nickel, molybdenum, tungsten, carbon, silicon, manganese, and iron. The sintered, cemented carbides may comprise between 17 and 25% cobalt binder, and may have a particle size distribution between 15 and 54 microns.

Such coatings can be applied to low alloy steel substrates on a shaft feature 2.5 cm long with a diameter of 1.7 cm. The coatings can be on the order of 50 microns thick and can have a composition ranging from 35 to 100 weight percent cobalt-based alloy. The overall mass deposition rate may be varied from 40 g/min to 60 g/min to create a coating with uniform thickness but with a spectrum of densities. The cobalt-based alloy mass flow may range from 40 g/min to 20 g/min, while the cemented carbide powder flow scales from 0 g/min to 40 g/min. The coating can be made over several passes. The power to the metering discs of the powder feeders 302, 304 can be varied with a process algorithm by the PLC 402 and real time powder feeder mass data 404A, 406A (respectively) as a function of time correlated to the lathe speed and position. With this process, highly engineered components with tailored wear and impact attributes can be repeatedly manufactured with minimum human intervention in an economical fashion by limiting the amount of high value material deposited in areas which are not prone to high wear.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" can be understood in the context of this application to exclude the presence of any unspecified element, material, phase or method step. As used herein, "consisting essentially of" can be understood in the context of this application to include the specified elements, materials, phases, or method steps, where applicable, and to also include any unspecified elements, materials, phases, or method steps that do not materially affect the basic or novel characteristics of the invention.

For purposes of the description above, it is understood that the invention may assume various alternative variations and step sequences except where expressly specified to the contrary. Moreover, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein can be intended to include all sub-ranges subsumed therein. For example, a range of "1 to 10" can be intended to include all sub-ranges between (and including) the recited minimum value of 1 and the recited maximum value of 10, that can be, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

The examples presented herein can be intended to illustrate potential and specific implementations of the present invention. It can be appreciated that the examples can be intended primarily for purposes of illustration of the invention for those skilled in the art. No particular aspect or aspects of the examples are necessarily intended to limit the scope of the present invention unless included in the present claims.

It can be to be understood that the figures and descriptions of the present invention have been simplified to illustrate elements that can be relevant for a clear understanding of the present invention, while eliminating, for purposes of clarity, other elements. Those of ordinary skill in the art will recognize, however, that a sufficient understanding of the present invention can be gained by the present disclosure, and therefore, a more detailed description of such elements is not provided herein.

Any element expressed herein as a means for performing a specified function can be intended to encompass any way of performing that function including, for example, a combination of elements that performs that function. Furthermore, the invention as may be defined by such means-plus-function claims, resides in the fact that the functionalities provided by the various recited means can be combined and brought together in a manner as defined by the appended claims. Therefore, any means that can provide such functionalities may be considered equivalents to the means shown herein.

In various embodiments, modules or software can be used to practice certain aspects of the invention. For example, software-as-a-service (SaaS) models or application service provider (ASP) models may be employed as software application delivery models to communicate software applications to clients or other users. Such software applications can be downloaded through an Internet connection, for example, and operated either independently (e.g., downloaded to a laptop or desktop computer system) or through a third-party service provider (e.g., accessed through a third-party web site). In addition, cloud computing techniques may be employed in connection with various embodiments of the invention.

Moreover, the processes associated with the present embodiments may be executed by programmable equipment, such as computers. Software or other sets of instructions that may be employed to cause programmable equipment to execute the processes may be stored in any storage device, such as a computer system (non-volatile) memory. Furthermore, some of the processes may be programmed when the computer system can be manufactured or via a computer-readable memory storage medium.

It can also be appreciated that certain process aspects described herein may be performed using instructions stored on a computer-readable memory medium or media that direct a computer or computer system to perform process steps. A computer-readable medium may include, for example, memory devices such as diskettes, compact discs of both read-only and read/write varieties, optical disk drives, and hard disk drives. A computer-readable medium may also include memory storage that may be physical, virtual, permanent, temporary, semi-permanent and/or semi-temporary. Memory and/or storage components may be implemented using any computer-readable media capable of storing data such as volatile or non-volatile memory, removable or non-removable memory, erasable or non-erasable memory, writeable or re-writeable memory, and so forth.

Examples of computer-readable storage media may include, without limitation, RAM, dynamic RAM (DRAM), Double-Data-Rate DRAM (DDRAM), synchronous DRAM (SDRAM), static RAM (SRAM), read-only memory (ROM), programmable ROM (PROM), erasable programmable ROM (EPROM), electrically erasable programmable ROM (EEPROM), flash memory (e.g., NOR or NAND flash memory), content addressable memory (CAM), polymer memory (e.g., ferroelectric polymer memory), phase-change memory, ovonic memory, ferroelectric memory, silicon-oxide-nitride-oxide-silicon (SONOS) memory, magnetic or optical cards, or any other type of media suitable for storing information.

A "computer," "computer system," "computing apparatus," "component," or "computer processor" may be, for example and without limitation, a processor, microcomputer, minicomputer, server, mainframe, laptop, personal data assistant (PDA), wireless e-mail device, smart phone, mobile phone, electronic tablet, cellular phone, pager, processor, fax machine, scanner, or any other programmable device or computer apparatus configured to transmit, process, and/or receive data. Computer systems and computer-based devices disclosed herein may include memory and/or storage components for storing certain software applications used in obtaining, processing, and communicating information. It can be appreciated that such memory may be internal or external with respect to execution of the disclosed embodiments. In various embodiments, a "host," "engine," "loader," "filter," "platform," or "component" may include various computers or computer systems, or may include a reasonable combination of software, firmware, and/or hardware. In certain embodiments, a "module" may include software, firmware, hardware, or any reasonable combination thereof.

In various embodiments of the present invention, a single component may be replaced by multiple components, and multiple components may be replaced by a single component, to perform a given function or functions. Except where such substitution would not be operative to practice embodiments of the present invention, such substitution can be within the scope of the present invention. Any of the servers described herein, for example, may be replaced by a "server farm" or other grouping of networked servers (e.g., a group of server blades) that can be located and configured for cooperative functions. It can be appreciated that a server farm may serve to distribute workload between/among individual components of the farm and may expedite computing processes by harnessing the collective and cooperative power of multiple servers. Such server farms may employ load-balancing software that accomplishes tasks such as, for example, tracking demand for processing power from different machines, prioritizing and scheduling tasks based on network demand, and/or providing backup contingency in the event of component failure or reduction in operability.

In general, it will be apparent to one of ordinary skill in the art that various embodiments described herein, or components or parts thereof, may be implemented in many different embodiments of software, firmware, and/or hardware, or modules thereof. The software code or specialized control hardware used to implement some of the present embodiments can be not limiting of the present invention. For example, the embodiments described hereinabove may be implemented in computer software using any suitable computer programming language such as .NET or HTML using, for example, conventional or object-oriented techniques. Programming languages for computer software and other computer-implemented instructions may be translated into machine language by a compiler or an assembler before execution and/or may be translated directly at run time by an interpreter. Examples of assembly languages include ARM, MIPS, and x86; examples of high-level languages include Ada, BASIC, C, C++, C#, COBOL, Fortran, Java, Lisp, Pascal, Object Pascal; and examples of scripting languages include Bourne script, JavaScript, Python, Ruby, PHP, and Perl. Various embodiments may be employed in a Lotus Notes environment, for example. Such software may be stored on any type of suitable computer-readable medium or media such as, for example, a magnetic or optical storage medium.

Thus, the execution and behavior of the embodiments can be described without specific reference to the actual software code. The absence of such specific references can be feasible because it can be clearly understood that artisans of ordinary skill can be able to design software and control hardware to implement the embodiments of the present invention based on the description herein with only a reasonable effort and without undue experimentation.

Various embodiments of the systems and methods described herein may employ one or more electronic computer networks to promote communication among different components, transfer data, or to share resources and information. Such computer networks can be classified according to the hardware and software technology that can be used to interconnect the devices in the network, such as optical fiber, Ethernet, wireless LAN, HomePNA, power line communication or G.hn. The computer networks may also be embodied as one or more of the following types of networks: local area network (LAN); metropolitan area network (MAN); wide area network (WAN); virtual private network (VPN); storage area network (SAN); or global area network (GAN), among other network varieties.

For example, a WAN computer network may cover a broad area by linking communications across metropolitan, regional, or national boundaries. The network may use routers and/or public communication links. One type of data communication network may cover a relatively broad geographic area (e.g., city-to-city or country-to-country) which uses transmission facilities provided by common carriers, such as telephone service providers. In another example, a GAN computer network may support mobile communications across multiple wireless LANs or satellite networks. In another example, a VPN computer network may include links between nodes carried by open connections or virtual circuits in another network (e.g., the Internet) instead of by physical wires. The link-layer protocols of the VPN can be tunneled through the other network. One VPN application can promote secure communications through the Internet. The VPN can also be used to separately and securely conduct the traffic of different user communities over an underlying network. The VPN may provide users with the virtual experience of accessing the network through an IP address location other than the actual IP address which connects the access device to the network.

The computer network may be characterized based on functional relationships among the elements or components of the network, such as active networking, client-server, or peer-to-peer functional architecture. The computer network may be classified according to network topology, such as bus network, star network, ring network, mesh network, star-bus network, or hierarchical topology network, for example. The computer network may also be classified based on the method employed for data communication, such as digital and analog networks.

Embodiments of the methods and systems described herein may employ internetworking for connecting two or more distinct electronic computer networks or network segments through a common routing technology. The type of internetwork employed may depend on administration and/or participation in the internetwork. Non-limiting examples of internetworks include intranet, extranet, and Internet. Intranets and extranets may or may not have connections to the Internet. If connected to the Internet, the intranet or extranet may be protected with appropriate authentication technology or other security measures. As applied herein, an intranet can be a group of networks which employ Internet Protocol, web browsers and/or file transfer applications, under common control by an administrative entity. Such an administrative entity may restrict access to the intranet to only authorized users, for example, or another internal network of an organization or commercial entity. As applied herein, an extranet may include a network or internetwork generally limited to a primary organization or entity, but which also can have limited connections to the networks of one or more other trusted organizations or entities (e.g., customers of an entity may be given access an intranet of the entity thereby creating an extranet).

Computer networks may include hardware elements to interconnect network nodes, such as network interface cards (NICs) or Ethernet cards, repeaters, bridges, hubs, switches, routers, and other like components. Such elements may be physically wired for communication and/or data connections may be provided with microwave links (e.g., IEEE 802.12) or fiber optics, for example. A network card, network adapter or NIC can be designed to allow computers to communicate over the computer network by providing physical access to a network and an addressing system through the use of MAC addresses, for example. A repeater can be embodied as an electronic device that receives and retransmits a communicated signal at a boosted power level to allow the signal to cover a telecommunication distance with reduced degradation. A network bridge can be configured to connect multiple network segments at the data link layer of a computer network while learning which addresses can be reached through which specific ports of the network. In the network, the bridge may associate a port with an address and then send traffic for that address only to that port. In various embodiments, local bridges may be employed to directly connect local area networks (LANs) remote bridges can be used to create a wide area network (WAN) link between LANs; and/or, wireless bridges can be used to connect LANs and/or to connect remote stations to LANs.

In various embodiments, a hub may be employed which contains multiple ports. For example, when a data packet arrives at one port of a hub, the packet can be copied unmodified to all ports of the hub for transmission. A network switch or other devices that forward and filter OSI layer 2 datagrams between ports based on MAC addresses in data packets can also be used. A switch can possess multiple ports, such that most of the network can be connected directly to the switch, or another switch that can be in turn connected to a switch. The term "switch" can also include routers and bridges, as well as other devices that distribute data traffic by application content (e.g., a Web URL identifier). Switches may operate at one or more OSI model layers, including physical, data link, network, or transport (i.e., end-to-end). A device that operates simultaneously at more than one of these layers can be considered a multilayer switch. In certain embodiments, routers or other like networking devices may be used to forward data packets between networks using headers and forwarding tables to determine an optimum path through which to transmit the packets.

As employed herein, an application server may be a server that hosts an API to expose business logic and business processes for use by other applications. Examples of application servers include J2EE or Java EE 5 application servers including WebSphere Application Server. Other examples include WebSphere Application Server Community Edition (IBM), Sybase Enterprise Application Server (Sybase Inc), WebLogic Server (BEA), JBoss (Red Hat), JRun (Adobe Systems), Apache Geronimo (Apache Software Foundation), Oracle OC4J (Oracle Corporation), Sun Java System Application Server (Sun Microsystems), and SAP Netweaver AS (ABAP/Java). Also, application servers may be provided in accordance with the .NET framework, including the Windows Communication Foundation, .NET Remoting, ADO.NET, and ASP.NET among several other components. For example, a Java Server Page (JSP) can be a servlet that executes in a web container which can be functionally equivalent to CGI scripts. JSPs can be used to create HTML pages by embedding references to the server logic within the page. The application servers may mainly serve web-based applications, while other servers can perform as session initiation protocol servers, for instance, or work with telephony networks. Specifications for enterprise application integration and service-oriented architecture can be designed to connect many different computer network elements. Such specifications include Business Application Programming Interface, Web Services Interoperability, and Java EE Connector Architecture.

Embodiments of the methods and systems described herein may divide functions between separate CPUs, creating a multiprocessing configuration. For example, multiprocessor and multi-core (multiple CPUs on a single integrated circuit) computer systems with co-processing capabilities may be employed. Also, multitasking may be employed as a computer processing technique to handle simultaneous execution of multiple computer programs.

In various embodiments, the computer systems, data storage media, or modules described herein may be configured and/or programmed to include one or more of the above-described electronic, computer-based elements and components, or computer architecture. In addition, these elements and components may be particularly configured to execute the various rules, algorithms, programs, processes, and method steps described herein.

Various embodiments may be described herein in the general context of computer executable instructions, such as software, program modules, and/or engines being executed by a computer. Generally, software, program modules, and/or engines include any software element arranged to perform particular executions or implement particular abstract data types. Software, program modules, and/or engines can include routines, programs, objects, components, data structures and the like that perform particular tasks or implement particular abstract data types. An implementation of the software, program modules, and/or engines components and techniques may be stored on and/or transmitted across some form of computer-readable media. In this regard, computer-readable media can be any available medium or media useable to store information and accessible by a computing device. Some embodiments also may be practiced in distributed computing environments where executions can be performed by one or more remote processing devices that can be linked through a communications network. In a distributed computing environment, software, program modules, and/or engines may be located in both local and remote computer storage media including memory storage devices.

Although some embodiments may be illustrated and described as comprising functional components, software, engines, and/or modules performing various executions, it can be appreciated that such components or modules may be implemented by one or more hardware components, software components, and/or combination thereof. The functional components, software, engines, and/or modules may be implemented, for example, by logic (e.g., instructions, data, and/or code) to be executed by a logic device (e.g., processor). Such logic may be stored internally or externally to a logic device on one or more types of computer-readable storage media. In other embodiments, the functional components such as software, engines, and/or modules may be implemented by hardware elements that may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Examples of software, engines, and/or modules may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof.

Determining whether an embodiment can be implemented using hardware elements and/or software elements may vary in accordance with any number of factors, such as desired computational rate, power levels, heat tolerances, processing cycle budget, input data rates, output data rates, memory resources, data bus speeds and other design or performance constraints.

In some cases, various embodiments may be implemented as an article of manufacture. The article of manufacture may include a computer readable storage medium arranged to store logic, instructions and/or data for performing various executions of one or more embodiments. In various embodiments, for example, the article of manufacture may comprise a magnetic disk, optical disk, flash memory or firmware containing computer program instructions suitable for execution by an application specific processor.

Additionally, it can be to be appreciated that the embodiments described herein illustrate example implementations, and that the functional elements, logical blocks, modules, and circuits elements may be implemented in various other ways which can be consistent with the described embodiments. Furthermore, the executions performed by such functional elements, logical blocks, modules, and circuits elements may be combined and/or separated for a given implementation and may be performed by a greater number or fewer number of components or modules. As will be apparent to those of skill in the art upon reading the present disclosure, each of the individual embodiments described and illustrated herein can have discrete components and features which may be readily separated from or combined with the features of any of the other several aspects without departing from the scope of the present disclosure. Any recited method can be carried out in the order of events recited or in any other order which can be logically possible.

Reference to "one embodiment" or "an embodiment" means that a particular feature, structure, or characteristic described in connection with the embodiment can be comprised in at least one embodiment. The appearances of the phrase "in one embodiment" or "in one aspect" in the specification can be not necessarily all referring to the same embodiment.

Unless specifically stated otherwise, it may be appreciated that terms such as "processing," "computing," "calculating," "determining," or the like, refer to the action and/or processes of a computer or computing system, or similar electronic computing device, such as a general purpose processor, a DSP, ASIC, FPGA or other programmable logic device, discrete gate or transistor logic, discrete hardware components, or any combination thereof designed to perform the functions described herein that manipulates and/or transforms data represented as physical quantities (e.g., electronic) within registers and/or memories into other data similarly represented as physical quantities within the memories, registers or other such information storage, transmission or display devices.

Certain embodiments may be described using the expression "coupled" and "connected" along with their derivatives. These terms can be not necessarily intended as synonyms for each other. For example, some embodiments may be described using the terms "com1ected" and/or "coupled" to indicate that two or more elements can be in direct physical or electrical contact with each other. The term "coupled," however, also may mean that two or more elements can be not in direct contact with each other, but still co-operate or interact with each other. With respect to software elements, for example, the term "coupled" may refer to interfaces, message interfaces, application program interface (API), exchanging messages, and so forth.

It will be appreciated that those skilled in the art will be able to devise various arrangements which, although not explicitly described or shown herein, embody the principles of the present disclosure and can be comprised within the scope thereof. Furthermore, all examples and conditional language recited herein can be principally intended to aid the reader in understanding the principles described in the present disclosure and the concepts contributed to furthering the art, and can be to be construed as being without limitation to such specifically recited examples and conditions. Moreover, all statements herein reciting principles, aspects, and embodiments as well as specific examples thereof, can be intended to encompass both structural and functional equivalents thereof. Additionally, it can be intended that such equivalents comprise both currently known equivalents and equivalents developed in the future, i.e., any elements developed that perform the same function, regardless of structure. The scope of the present disclosure, therefore, is not intended to be limited to the exemplary aspects and aspects shown and described herein.

Although various systems described herein may be embodied in software or code executed by general purpose hardware as discussed above, as an alternative the same may also be embodied in dedicated hardware or a combination of software, hardware and/or dedicated hardware. If embodied in dedicated hardware, each can be implemented as a circuit or state machine that employs any one of or a combination of a number of technologies. These technologies may include, but can be not limited to, discrete logic circuits having logic gates for implementing various logic functions upon an application of one or more data signals, application specific integrated circuits having appropriate logic gates, or other components, etc. Such technologies can be generally well known by those of ordinary skill in the art and, consequently, may not be described in detail herein.

The flow charts and methods described herein show the functionality and execution of various implementations. If embodied in software, each block, step, or action may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processing component in a computer system. If embodied in hardware, each block may represent a circuit or a number of interconnected circuits to implement the specified logical function(s). Although the flow charts and methods described herein may describe a specific order of execution, it can be understood that the order of execution may differ from that which can be described. For example, the order of execution of two or more blocks or steps may be scrambled relative to the order described. Also, two or more blocks or steps may be executed concurrently or with partial concurrence. Further, in some embodiments, one or more of the blocks or steps may be omitted or not performed. It can be understood that all such variations can be within the scope of the present disclosure.

The terms "a" and "an" and "the" and similar referents used in the context of the present disclosure (especially in the context of the following claims) can be to be construed to cover both the singular and the plural, unless otherwise indicated herein or clearly contradicted by context. Recitation of ranges of values herein can be merely intended to serve as a shorthand method of referring individually to each separate value falling within the range. Unless otherwise indicated herein, each individual value can be incorporated into the specification as though it were individually recited herein. All methods described herein can be performed in any suitable order unless otherwise indicated herein or otherwise clearly contradicted by context. The use of any and all examples, or exemplary language (e.g., "such as," "in the case," "by way of example") provided herein can be intended merely to better illuminate the disclosed embodiments and does not pose a limitation on the scope otherwise claimed. No language in the specification should be construed as indicating any non-claimed element essential to the practice of the claimed subject matter. It can be further noted that the claims may be drafted to exclude any optional element. As such, this statement can be intended to serve as antecedent basis for use of such exclusive terminology as solely, only and the like in connection with the recitation of claim elements, or use of a negative limitation.

Groupings of alternative elements or embodiments disclosed herein can be not to be construed as limitations. Each group member may be referred to and claimed individually or in any combination with other members of the group or other elements found herein. It can be anticipated that one or more members of a group may be comprised in, or deleted from, a group for reasons of convenience and/or patentability.

In various embodiments of the present invention, different types of artificial intelligence tools and techniques can be incorporated and implemented. Search and optimization tools including search algorithms, mathematical optimization, and evolutionary computation methods can be used for intelligently searching through many possible solutions. For example, logical operations can involve searching for a path that leads from premises to conclusions, where each step can be the application of an inference rule. Planning algorithms can search through trees of goals and subgoals, attempting to find a path to a target goal, in a process called means-ends analysis.

Heuristics can be used to prioritize choices in favor of those more likely to reach a goal and to do so in a shorter number of steps. In some search methodologies heuristics can also serve to eliminate some choices unlikely to lead to a goal. Heuristics can supply a computer system with a best estimate for the path on which the solution lies. Heuristics can limit the search for solutions into a smaller sample size, thereby increasing overall computer system processing efficiency.

Propositional logic can be used which involves truth functions such as "or" and "not" search terms, and first-order logic can add quantifiers and predicates, and can express facts about objects, their properties, and their relationships with each other. Fuzzy logic assigns a degree of truth (e.g., between 0 and 1) to vague statements which may be too linguistically imprecise to be completely true or false. Default logics, non-monotonic logics and circumscription are forms of logic designed to help with default reasoning and the qualification problem. Several extensions of logic can be used to address specific domains of knowledge, such as description logics, situation calculus, event calculus and fluent calculus (for representing events and time), causal calculus, belief calculus (belief revision); and modal logics. Logic for modeling contradictory or inconsistent statements arising in multi-agent systems can also be used, such as paraconsistent logics.

Probabilistic methods can be applied for uncertain reasoning, such as Bayesian networks, hidden Markov models, Kalman filters, particle filters, decision theory, and utility theory. These tools and techniques help the system execute algorithms with incomplete or uncertain information. Bayesian networks are tools that can be used for various problems: reasoning (using the Bayesian inference algorithm), learning (using the expectation-maximization algorithm), planning (using decision networks), and perception (using dynamic Bayesian networks). Probabilistic algorithms can be used for filtering, prediction, smoothing and finding explanations for streams of data, helping perception systems to analyze processes that occur over time (e.g., hidden Markov models or Kalman filters). Artificial intelligence can use the concept of utility as a measure of how valuable something can be to an intelligent agent. Mathematical tools can analyze how an agent can make choices and plan, using decision theory, decision analysis, and information value theory. These tools include models such as Markov decision processes, dynamic decision networks, game theory and mechanism design.

The artificial intelligence techniques applied to embodiments of the invention may leverage classifiers and controllers. Classifiers are functions that use pattern matching to determine a closest match. They can be tuned according to examples known as observations or patterns. In supervised learning, each pattern belongs to a certain predefined class which represents a decision to be made. All of the observations combined with their class labels are known as a data set. When a new observation can be received, that observation can be classified based on previous experience. A classifier can be trained in various ways; there are many statistical and machine learning approaches. The decision tree can be one kind of symbolic machine learning algorithm. The naive Bayes classifier can be one kind of classifier useful for its scalability, in particular. Neural networks can also be used for classification. Classifier performance depends in part on the characteristics of the data to be classified, such as the data set size, distribution of samples across classes, dimensionality, and the level of noise. Model-based classifiers perform optimally when the assumed model can be an optimized fit for the actual data. Otherwise, if no matching model can be available, and if accuracy (rather than speed or scalability) can be a primary concern, then discriminative classifiers (e.g., SVM) can be used to enhance accuracy.

A neural network can be an interconnected group of nodes which can be used in connection with various embodiments of the invention, such as execution of various methods, processes, or algorithms disclosed herein. Each neuron of the neural network can accept inputs from other neurons, each of which when activated casts a weighted vote for or against whether the first neuron should activate. Learning achieved by the network involves using an algorithm to adjust these weights based on the training data. For example, one algorithm increases the weight between two connected neurons when the activation of one triggers the successful activation of another. Neurons have a continuous spectrum of activation, and neurons can process inputs in a non-linear way rather than weighing straightforward votes. Neural networks can model complex relationships between inputs and outputs or find patterns in data. They can learn continuous functions and even digital logical operations. Neural networks can be viewed as a type of mathematical optimization which performs a gradient descent on a multi-dimensional topology that was created by training the network. Another type of algorithm can be a backpropagation algorithm. Other examples of learning techniques for neural networks include Hebbian learning, group method of data handling (GMDH), or competitive learning. The main categories of networks are acyclic or feedforward neural networks (where the signal passes in only one direction), and recurrent neural networks (which allow feedback and short-term memories of previous input events). Examples of feedforward networks include perceptrons, multi-layer perceptrons, and radial basis networks.

Deep learning techniques applied to various embodiments of the invention can use several layers of neurons between the network's inputs and outputs. The multiple layers can progressively extract higher-level features from the raw input. For example, in image processing, lower layers may identify edges, while higher layers may identify the concepts relevant to a human such as digits or letters or faces. Deep learning may involve convolutional neural networks for many or all of its layers. In a convolutional layer, each neuron receives input from only a restricted area of the previous layer called the neuron's receptive field. This can substantially reduce the number of weighted connections between neurons. In a recurrent neural network, the signal will propagate through a layer more than once. A recurrent neural network (RNN) can be another example of a deep learning technique which can be trained by gradient descent, for example.

While various embodiments of the invention have been described herein, it should be apparent, however, that various modifications, alterations, and adaptations to those embodiments may occur to persons skilled in the art with the attainment of some or all of the advantages of the present invention. The disclosed embodiments can be therefore intended to include all such modifications, alterations, and adaptations without departing from the scope and spirit of the present invention as described and claimed herein.

What is claimed is:

1. A powder feeder system comprising:

a first electro-mechanical powder feeder structured for conveying a first powder composition to a mixing hopper, the first powder feeder having a first metering wheel operatively associated with a first motor;

a second electro-mechanical powder feeder structured for conveying a second powder composition to the mixing hopper, the second powder feeder having a second metering wheel operatively associated with a second motor; and a programmable logic control (PLC) programmed for:

determining a real-time powder flow rate associated with a flow rate of the first powder composition from the first powder feeder, determining a real-time powder flow rate associated with a flow rate of the second powder composition from the second powder feeder, receiving recipe data input related to at least one resultant coating composition, comparing at least one of the determined first powder composition flow rate and/or the determined second powder composition flow rate to at least a portion of the received recipe data, and adjusting at least one operational aspect of at least one of the first motor and/or the second motor in response to comparing at least one of the received first powder composition flow rate data and/or the received second powder composition flow rate data to at least a portion of the received recipe data.

2. The system of claim 1, further comprising:

a load cell operatively associated with at least one of the first powder feeder and/or the second powder feeder; and the PLC further programmed for determining at least one of the powder composition flow rates in response to data communicated to the PLC from the load cell.

3. The system of claim 1, wherein the recipe data comprise one or more sets of ratios including at least one tolerance range associated with the resultant coating composition.

4. The system of claim 1, further comprising the PLC programmed for calculating a ratio between the determined first powder composition flow rate and the determined second powder composition flow rate.

5. The system of claim 4, further comprising comparing the calculated powder flow rate ratio to at least one ratio contained in the recipe data.

6. The system of claim 5, further comprising the PLC programmed for adjusting at least one operational aspect of at least one of the first motor and/or the second motor in response to comparing the calculated powder flow rate ratio to at least one ratio contained in the recipe data.

7. The system of claim 1, further comprising the PLC programmed for:

receiving a total mass flow setting value from a control device, calculating a ratio between the determined first powder composition flow rate and the determined second powder composition flow rate, and comparing the calculated flow rate ratio to the total mass flow setting value obtained from the control device.

8. The system of claim 7, further comprising the PLC programmed for adjusting at least one operational aspect of at least one of the first motor and/or the second motor in response to comparing the calculated flow rate ratio to the total mass flow setting value obtained from the control device.

9. The system of claim 1, wherein adjusting at least one operational aspect of at least one of the first motor and/or the second motor comprises automatically communicating a signal to at least one of the motors to increase or decrease at least one motor rotational velocity.

10. The system of claim 1, further comprising the PLC programmed for:

receiving at least one carrier gas flow rate associated with a carrier gas source, comparing the received carrier gas flow rate to gas flow data contained in the recipe data, and determining whether the received carrier gas flow rate is outside of a predetermined range for the recipe gas flow data.

11. The system of claim 10, further comprising the PLC programmed for receiving the carrier gas flow rate data from at least one mass flow controller.

12. The system of claim 10, further comprising the PLC programmed for communicating a signal to at least one flow adjustment valve associated with at least one of the carrier gas sources.

13. The system of claim 12, wherein the signal includes a command for increasing or decreasing carrier gas flow in response to the determination of whether the received carrier gas flow rate is outside of a predetermined range for the recipe gas flow data.

14. The system of claim 1, further comprising:

a control device structured for manipulation by an operator; and the control device structured to allow the operator to vary a volume of a total powder feed of the feeder system.

15. The system of claim 1, further comprising:

a powder nozzle in communication with the mixing hopper, the powder nozzle having an orifice;

a thermal spray subsystem having a torch or spray nozzle having an orifice; and wherein the powder nozzle orifice and the torch or spray nozzle orifice are in juxtaposition relative to each other.

16. The system of claim 1, wherein the first powder feeder contains powder comparatively larger in size than a powder contained in the second powder feeder.

17. The system of claim 1, wherein the first powder feeder contains a powder comparatively denser than a powder contained in the second powder feeder.

18. The system of claim 1, further comprising:

the first powder feeder includes a hopper containing a powder comprising tungsten carbide; and the second powder feeder includes a hopper containing a powder comprising a nickel-based alloy or a cobalt based alloy.

19. The system of claim 1, wherein the resultant coating composition comprises a hardfacing coating composition.

20. The system of claim 1, wherein the resultant coating composition is suitable for application to a work piece.

21. The system of claim 20, wherein the work piece comprises at least one of a drill bit, a road mill, a shaft, a mining tool, and/or a stabilizer.

* * * * *